United States Patent [19]

Kegler

[11] 4,043,898

[45] Aug. 23, 1977

[54] CONTROL OF FEEDSTOCK FOR DELAYED COKING

[75] Inventor: William H. Kegler, Ponca City, Okla.

[73] Assignee: Continental Oil Company, Ponca City, Okla.

[21] Appl. No.: 607,728

[22] Filed: Aug. 25, 1975

[51] Int. Cl.[2] ..... C10G 9/14

[52] U.S. Cl. ..... 208/50; 208/131

[58] Field of Search ..... 208/46, 50, 131

[56] References Cited

U.S. PATENT DOCUMENTS

| | | | |
|---|---|---|---|
| 2,922,755 | 1/1960 | Hackley | 208/50 |
| 3,412,009 | 11/1968 | Smith et al. | 208/131 |
| 3,451,921 | 6/1969 | Janes | 208/46 |
| 3,547,804 | 12/1970 | Noguchi et al. | 208/131 |
| 3,759,822 | 9/1973 | Folkins | 208/131 |

*Primary Examiner*—Herbert Levine

*Attorney, Agent, or Firm*—Richard W. Collins

[57] ABSTRACT

Characteristics of the feedstock for a delayed coking operation are determined prior to carrying out the coking operation, and the feedstock is adjusted by blending, thermal cracking, or other processing to provide certain predetermined characteristics to the feedstock prior to conducting the coking operation. Feedstocks having desired predetermined characteristics produce a premium grade coke having very low coefficient of thermal expansion.

6 Claims, 1 Drawing Figure

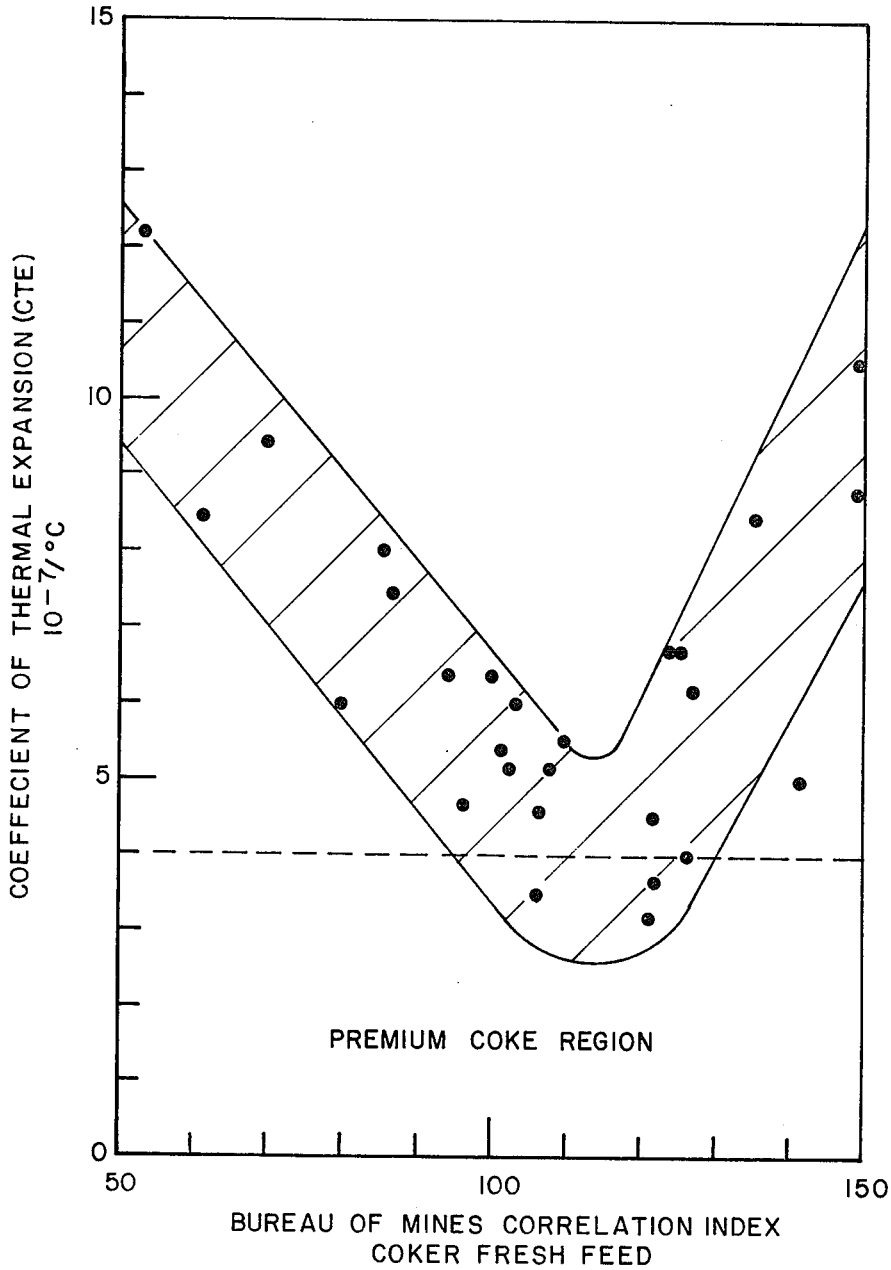
15
10
5
0
COEFFECIENT OF THERMAL EXPANSION (CTE)
10−7/°C
PREMIUM COKE REGION
50
100
150
BUREAU OF MINES CORRELATION INDEX
COKER FRESH FEED

CONTROL OF FEEDSTOCK FOR DELAYED COKING

BACKGROUND OF THE INVENTION

1. Field of the Invention

This invention relates to production of delayed petroleum coke and more particularly to a reliable method of providing a feedstock which will produce a premium grade coke having a very low coefficient of thermal expansion.

2. Description of the Prior Art

The delayed coking of petroleum residual oils is well established in the industry, providing the maximum return from residual oils in that it yields both coke and more desirable liquid and gaseous products, such as liquefied petroleum gas, gasoline, and gas oil. Delayed coking has become even more important in recent years in that it has also been found to be an excellent route to the production of premium grade or needle coke, useful in the production of large graphite electrodes, from certain selected feedstocks which are generally high in aromatic content.

There are a number of factors that determine the quality of coke. For example, sulfur content, hardness, metals content, electrode electrical resistivity, and coefficient of thermal expansion are all factors in determining the quality and value of delayed coke. Although each of these factors is important, the coefficient of thermal expansion (CTE) is the primary factor in determining the value of coke. The lower the coke's CTE, the more valuable the coke, and the better for production of large graphite electrodes.

Premium coke has customarily been produced in delayed cokers from thermal tars. These tars are made by the thermal cracking of virgin, thermal cracked, and catalytically cracked gas oils. Attempts to make premium coke from gas oil without first thermally cracking the gas oil have generally been unsuccessful, and attempts to predict coke quality from feedstock properties have been unsuccessful for the most part. The lack of success in producing premium coke without thermally cracking the feedstock, combined with the inability to accurately identify and quantify components in coker feedstocks, has led the industry to the belief that a thermal cracking operation is needed in conjunction with a coker installation in order to produce premium coke. Recent trends in the petroleum refining industry, such as the increased use of fluid catalytic cracking units in place of thermal cracking units, have forced the industry to search for a feedstock for delayed coking that does not require a thermal cracking step prior to coking.

As previously mentioned, coker feedstocks normally comprise residual oil which has been subjected to various processing steps prior to introduction to the coker. The nature of these feedstocks is such that it is virtually impossible to analyze them, and because of their source, they are subject to variation even when they have been subjected to similar processing prior to coking. U.S. Pat. No. 3,759,822 describes a method for producing premium coke comprising coking a blend of a thermally or catalytically cracked heavy oil having a high aromatic content with a quantity of a pyrolysis tar under rather conventional coking conditions. U.S. Pat. No. 2,922,755 to Hackley describes a process for producing premium coke in which the feedstock is a blend of a highly aromatic thermal tar with one or more refinery residues, such as reduced crude or hydroformer bottoms. The coking processes described in these patents, as well as other variations of the basic coking process, have been utilized previously with varying degrees of success in the production of premium delayed petroleum coke. However, there has been a continuing need for a better understanding of the relationship between coker feedstock and product quality. In many cases, for unexplained reasons, product quality has failed to meet specifications even though the feedstock was from the same origin as earlier feedstocks which produced high quality product. In this regard, the primary measure of product quality, as was mentioned previously, is the linear coefficient of thermal expansion, or CTE. The value of this measurement, in order for the product to be designated a premium coke, is not precise, but it is generally considered that a CTE of less than about $5.0 \times 10^{-7}$ per ° C is sufficient to designate the product as premium coke. However, the lower the CTE, the better, and in some cases, a batch of product having a particularly low CTE may be useful in blending product to produce an overall CTE of $5.0 \times 10^{-7}$ or whatever the designated specification might be.

Prior to this invention, there has been no reliable test to determine feedstock quality, and the upstream processing of the feedstock has been the primary basis for selection. This method is not always effective, for a number of reasons, in producing a premium grade coke.

Thus, it is apparent that there has been a continuing need for a method of predicting and improving the quality of delayed coke prior to actually producing the coke, such as by determining a characteristic of the feedstock which correlates with product quality, and adjusting the feedstock if necessary to produce the desired characteristic in the feedstock prior to conducting the coking operation.

SUMMARY OF THE INVENTION

According to the present invention, coker feedstock is analyzed prior to coking to determine a characterization factor based upon volumetric average boiling point and API gravity. This characterization factor has been found to be a reliable indication of product quality. The feedstock is adjusted by one of several alternative methods to have a characterization factor within a predetermined range which reliably results in high quality product prior to carrying out the delayed coking step.

BRIEF DESCRIPTION OF THE DRAWING

The drawing is a graph showing the relation between a characterization index and coke CTE.

DESCRIPTION OF THE PREFERRED EMBODIMENTS

In carrying out the process of the present invention, a characterization index value for a coker feedstock is determined prior to carrying out the coking step, and the feedstock, if it is not within a predetermined desired range as to the characterization index value, is adjusted by blending, distillation, cracking or any combination of these steps to bring the characterization factor within the predetermined range which has been determined according to the invention to result in a premium quality coke having a very low CTE value.

The characterization index which has been found to reliably predict product quality is based on the mean average boiling point of the feedstock and the API gravity of the feedstock. This characterization index was developed by the U.S. Bureau of Mines and is described in U.S. Bureau of Mines Technical Paper 610 (1940), authored by H. M. Smith. This characterization index is commonly known as the Bureau of Mines Correlation Index and is commonly referred to, and will be referred to herein, as BMCI.

By this invention, it has been found that the best coke quality (lowest CTE) is obtained from coker feedstocks having a particular level of aromaticity characterized by the BMCI value, which is directly proportional to the aromatic content of the stock and can be calculated by:

$$BMCI = \frac{87552}{T} + \frac{67029}{131.5 + G} - 456.8$$

where:

$T$ = Volumetric average boiling point, ° R $G$ = Gravity, ° API

The formula below is used to calculate volumetric average boiling point.

$$VABP = \frac{T_1 + T_2 + T_3 + T_4 + T_5}{5}$$

Where:

$T_1$ = Temperature at 10 volume percent distilled $T_2$ = Temperature at 30 volume percent distilled $T_3$ = Temperature at 50 volume percent distilled $T_4$ = Temperature at 70 volume percent distilled $T_5$ = Temperature at 90 volume percent distilled Temperatures at the 10 volume percent distilled, 30 volume percent distilled, etc., are summed and then divided by five. In cases (such as thermal tars) where complete distillations are not always available, the 50 percent point temperature is substituted for the volume average boiling point. The use of the 50 percent point temperature correlates very well with the value obtained for volume average boiling point, and in almost all cases is within three BMCI numbers.

Most coker operations utilize a moderate or high recycle, generally by passing overhead material from the coke drum to a coker fractionator, where the overheads as well as fresh feed to the system are fractionated to produce a bottoms product which is the furnace charge to the coking operation. In such cases, the BMCI of the furnace charge may be more indicative of the coke quality than is the BMCI of the fresh feed to the process, and the BMCI of the furnace charge can be varied by changing the conditions in the fractionator. For this reason, when the fresh feed and recycle are fed to a fractionator, and the fractionator bottoms are used as the furnace charge, the BMCI of the furnace charge may be a better indication of coke quality than is the BMCI of the fresh feed. In this situation, the term "feedstock" as used herein means furnace charge rather than fresh feed. As will be apparent, when the fresh feed to the process is introduced directly to the furnace, then the fresh feed is the feedstock.

Referring to the drawing, it will be seen that there is a sharp point of minimum CTE at a BMCI range of about 110 to 115. As the BMCI value varies in either direction, it can be seen that the CTE rises rapidly. The points on the graph were determined using a wide variety of feedstocks, and according to this invention, it has been determined that a BMCI number of from 95 to 130 is most likely to produce a premium coke having a CTE of $5.0 \times 10^{-7}$ per ° C or lower. As the BMCI value varies from this range in either direction, the prospects for obtaining a product coke having a CTE of $5.0 \times 10^{-7}$ per ° C or less become very remote. In the event that the feedstock as checked prior to coking has a BMCI within the range of 95 to 130, and particularly in the range of 110 to 115, the feedstock may be fed directly to the coking operation with the expectation that a premium grade product will be produced. If the BMCI of the feedstock is outside the range of 95 to 130, either higher or lower, then some adjustment to the feedstock must be made in order to have a high probability of obtaining a product coke having a CTE of $5.0 \times 10^{-7}$ per ° C or less. This adjustment of feedstock BMCI may be by any of several methods, of which blending is the most straightforward. Thermal cracking may be the most efficient way of adjusting the BMCI, particularly when the value is less than 95. Distillation or blending may be the most practical means of bringing the feedstock BMCI within the desired range if it is initially above 130. After adjustment of the feedstock, the BMCI is preferably rechecked to assure that it is within the preferred range prior to charging it to the furnace.

The results produced by this invention are illustrated by the following examples which were carried out in a pilot plant coker utilizing a variety of feedstocks which were adjusted according to a variety of methods to determine the relationship of BMCI of feedstock to product coke CTE.

EXAMPLE 1

In this example, a 50—50 weight percent mixture of thermally cracked cycle oil and fluid catalytically cracked (FCC) decant oil was coked, and further portions of the original blend were thermally cracked at different severities and the resulting tars coked. The BMCI of the original blend was 102, and the two tars produced had BMCI's of 148 and 125. The higher BMCI tar was produced at the more severe thermal cracker conditions. The physical properties of the original blend are shown in Table I.

TABLE I

PHYSICAL PROPERTIES OF THE THERMAL CRACKER FEEDSTOCK BLEND

| | |
|---|---|
| API Gravity | 6.3 |
| Specific Gravity | 1.0269 |
| ASTM Distillation | D-1160 |
| 5 Vol %, ° F | — |
| 10 | 641 |
| 20 | 681 |
| 30 | 711 |
| 40 | 732 |
| 50 | 755 |
| 60 | 782 |
| 70 | 843 |
| 80 | 850 |
| 90 | 911 |
| 95 | 988 |
| EP | 988 |
| Recovery | 95 |
| Conradson Carbon, wt % | 1.7 |
| Sulfur, wt % | 1.1 |
| Viscosity, cs at 100° F | 44.9 |
| 130° F | 18.8 |
| 210° F | 4.6 |
| BMCI | 102 |

The conditions of the two thermal cracking runs, which were not designed for optimum thermal cracking performance, but rather to produce two tars of different BMCI for the coking operation, are shown in Table II below.

TABLE II

| OPERATING CONDITIONS OF THERMAL CRACKER PILOT PLANT | | |
|---|---|---|
| Run No. | 1 | 2 |
| Feed Rate, lb/hr | 40 | 40 |
| Recycle Rate, lb/hr | 17 | 14 |
| Coil Outlet Temperature, ° F | 930 | 880 |
| Coil Pressure, psig | 720 | 720 |
| Tar Flash Drum, ° F, Top | 550 | 470 |
| Bottom | 705 | 650 |
| Column Temp (Top), ° F | 375 | 370 |
| Reboiler Temp, ° F | 470 | 460 |
| Column Reflux Ratio | 4 | 4 |

The resulting properties of the thermal tars produced at the two sets of conditions set forth in Table II are shown in the following Table III.

TABLE III

| THERMAL TAR PHYSICAL PROPERTIES | | |
|---|---|---|
| Thermal Cracker Run | 1 | 2 |
| API Gravity | −6.7 | −0.3 |
| Specific Gravity | 1.1338 | 1.0785 |
| ASTM Distillation | D-1160 | D-1160 |
| 5 Vol %, ° F' | 684 | 603 |
| 10 | 707 | 659 |
| 20 | 733 | 696 |
| 30 | 757 | 725 |
| 40 | 781 | 744 |
| 50 | 811 | 769 |
| 60 | 844 | 807 |
| 70 | 893 | 840 |
| 80 | 963 | 891 |
| 90 | — | 993 |
| 95 | — | 1,061 |
| EP | 1,031 | 1,061 |
| Recovery | 85 | 95 |
| Conradson Carbon Residue, wt % | 12.0 | — |
| Sulfur, wt % | 1.27 | — |
| Viscosity, cs at 250° F | 9.17 | — |
| 300° F | 4.48 | — |
| BMCI | 148 | 125 |

It will be seen that the higher BMCI value resulted from the higher thermal cracking temperature, which presumably resulted from an increase in condensation-polymerization.

The original blend and the two thermal tars were coked in a pilot plant coker under the following nominal conditions as set forth in Table IV.

TABLE IV

| DELAYED COKER PILOT PLANT OPERATING CONDITIONS | |
|---|---|
| Feed Rate, lbs/hr | 10 |
| Recycle Rate, lbs/hr | 10 |
| Furnace Outlet Temperature, ° F | 850 |
| Furnace Outlet Pressure, psig | 100 |
| Drum Pressure, psig | 25 |
| Drum Skin Temperature, ° F | 950 |
| Drum Head Temperature, ° F | 950 |
| Run Length, hrs | 8 |
| Total Recycle, min | 10 |
| Heat Soak, hrs | 2 |
| Steam, hrs | 2 |
| Combined feed ratio (Total feed/fresh feed) | 2.0 |

These conditions correspond to those generally appropriate for premium coke production. The coker product yields and coke quality data for the three feedstocks are shown in the following Table V.

TABLE V

| PRODUCT YIELDS AND COKE QUALITY DATA CASE I | | | |
|---|---|---|---|
| Coker Run No. | 1 | 2 | 3 |
| BMCI | | | |
| Fresh Feed | 102 | 125 | 148 |
| Furnace Charge | 107 | 127 | 144 |
| Product Yields | | | |
| $H_2$ | 0.05 | 0.08 | 0.15 |
| $H_2S$ | 008 | 0.12 | 0.16 |
| $C_1$ to $C_3$ | 5.4 | 5.5 | 5.8 |
| $C_4$ to 400° F | 1.7 | 4.5 | 2.6 |
| 400 to 650° F | 29.2 | 12.2 | 7.4 |
| 650° F+ | 36.2 | 50.9 | 43.8 |
| Coke (6% Volatile Matter) | 18.4 | 26.7 | 40.1 |
| Coke Quality | | | |
| Green Coke | | | |
| Volatile Matter, wt % | 9.2 | 7.5 | 7.8 |
| Calcined Coke | | | |
| Kerosene Density, g/cc | 2.12 | 2.12 | 2.12 |
| Graphitized Electrode | | | |
| CTE, $10^{-7}$/° C | 4.8 | 4.3 | 6.4 |

The 102 BMCI feedstock was the original blend of FCC and thermally cracked gas oils, and the other two feedstocks were the tars produced in the thermal cracker. For each coker run, a feedstock BMCI and a furnace charge BMCI were shown. The difference in the two values for each run results from the feed being mixed with recycle oil prior to entering the furnace. This example illustrates that the lowest CTE product was obtained with the 125 BMCI feedstock. This feedstock has been thermally cracked under relatively mild conditions. More severe thermal cracking produced a high BMCI feedstock (148). The original blend (102 BMCI) and the high BMCI feedstock (148) both resulted in cokes of lower quality (higher CTE). This example illustrates that feedstocks of low BMCI can be thermally cracked to produce a feedstock that will have an optimum BMCI for production of optimum coke quality at a given set of coker operating conditions. However, this example also illustrates that the feedstock cannot merely be cracked to the maximum degree practical, as the more severe thermal cracking produced a feedstock having a BMCI above the optimum range for production of low CTE coke.

EXAMPLE 2

This example illustrates the effect of blending a highly paraffinic bright stock oil in varying proportions with the high BMCI (148) thermal tar made in Example 1. The blends were coked at constant coker operating conditions as in Example 1. The physical properties of the two feedstocks and the four blends thereof are shown in Table VI below.

TABLE VI

| COKER FEEDSTOCK PROPERTIES | | | | | | |
|---|---|---|---|---|---|---|
| Feedstock | A | B | C | D | E | F |
| Feedstock Description | | | | | | |
| Bright Stock, wt % | — | 100 | 60 | 40 | 30 | 25 |
| Thermal Tar, wt % | 100 | — | 40 | 60 | 70 | 75 |
| API Gravity | −6.7 | 27.0 | 14.7 | 8.8 | 3.7 | 1.7 |
| Specific Gravity | 1.1338 | 0.8927 | 0.9676 | 1.0076 | 1.0466 | 1.0623 |
| ASTM Distillation, ° F (D-1160) | | | | | | |
| 5, Vol % | 684 | 899 | 702 | 679 | 683 | 693 |
| 10 | 707 | 940 | 739 | 699 | 709 | 720 |

TABLE VI-continued

| COKER FEEDSTOCK PROPERTIES | | | | | | |
|---|---|---|---|---|---|---|
| 20 | 733 | 983 | 811 | 748 | 754 | 755 |
| 30 | 757 | 1,019 | 897 | 821 | 785 | 787 |
| 40 | 781 | 1,047 | 967 | 886 | 834 | 826 |
| 50 | 811 | 1,076 | 1,018 | 950 | 890 | 874 |
| 60 | 844 | 1,101 | 1,057 | 1,013 | 953 | 939 |
| 70 | 893 | — | 1,077 | 1,057 | 995 | 1,008 |
| 80 | 963 | — | — | | | 1,059 |
| Conradson Carbon Residue, wt % | 12.0 | <0.1 | 3.4 | 4.1 | 7.3 | 8.5 |
| Sulfur, total, wt % | 1.27 | 0.12 | 0.71 | 0.96 | 1.06 | 1.11 |
| BMCI | 148 | 23 | 61 | 83 | 105 | 112 |

The four blends and two feedstocks provided a range of BMCI of from 23 (highly paraffinic) to 148 (highly aromatic). The resulting coker product yields and coke qaulity are tabulated in Table VII below.

TABLE VII

| PRODUCT YIELDS AND COKE QUALITY DATA | | | | | | |
|---|---|---|---|---|---|---|
| Feedstock | A | B | C | D | E | F |
| BMCI | | | | | | |
| Fresh Feed | 148 | 23 | 61 | 83 | 105 | 112 |
| Furnace Charge | 145 | 37 | 82 | 98 | 113 | 126 |
| Product Yields | | | | | | |
| $H_2$ | 0.15 | 0.03 | 0.05 | 0.08 | 0.07 | 0.10 |
| $H_2S$ | 0.16 | 0.00 | 0.11 | 0.11 | 0.09 | 0.10 |
| $C_1$ to $C_3$ | 5.8 | 12.1 | 8.5 | 7.9 | 6.7 | 6.6 |
| $C_4$ to 400° F | 2.6 | 12.8 | 74.9 | 68.9 | 65.9 | 64.0 |
| 400 to 650° F | 7.4 | 18.2 | | | | |
| 650° F+ | 43.8 | 52.0 | | | | |
| Coke (6% VM) | 40.1 | 4.9 | 16.4 | 23.0 | 27.2 | 29.2 |
| Coke Quality | | | | | | |
| Green Coke | | | | | | |
| Volatile Matter, wt % | 7.8 | 9.8 | 8.8 | 6.3 | 9.5 | 8.0 |
| Sulfur, wt % | — | 0.60 | 1.01 | 1.00 | 1.1 | 1.09 |
| Calcined Coke | | | | | | |
| Kerosene Density, g/cc | 2.12 | 2.13 | 2.12 | 2.12 | 2.12 | 2.12 |
| Graphitized Electrode | | | | | | |
| CTE, $10^{-7}/°$ C | 6.4 | 11.7 | 4.2 | 3.4 | 4.7 | 4.0 |

It can be seen from Table VII that premium coke was produced by each of the blends, whereas the unblended charge stocks each produced a coke having an unacceptably high CTE. The blend having the least thermal tar (40 percent), which had a BMCI of 61 initially and 82 as charged to the furnace, produced a coke having an acceptable CTE, but it will be noted that the yield was considerably less than that for the feedstocks having a BMCI within the range of 95 to 130.

There may be certain situations, or certain types of feedstock, for which the BMCI range of 95 to 130 is not the desired or optimum range. In such cases, some other preselected range may be indicated, and the invention in its broader aspects provides for controlling a coking operation by preselecting a BMCI range to provide a desired result, checking the BMCI of the feedstock, and adjusting the BMCI of the feedstock to the preselected range. Such a situation might exist where coke yield was not of importance, but coke CTE was. In such a case, a BMCI outside the range of 95 to 130 might be preselected to suit the specific situation. It is also possible that certain types of feedstocks would have a BMCI range outside the range of 95 to 130 to produce optimum results. In such a case, the invention is applicable and involves the steps of preselecting a desired BMCI range for the feedstock, determining the BMCI of the feedstock, and adjusting the BMCI of the feedstock if it is not within the preselected range.

The reason for the low CTE value of coke produced from feedstocks having a BMCI value between 95 and 130 cannot be stated with certainty, but it is a furtunate circumstance that the BMCI number can be quickly determined for a given feedstock since the volume average boiling point and the gravity of the feedstock are two factors which are almost always available as a matter of course for any particular stream or stock in a refinery. Also, the correlation of BMCI with coker feedstock is very good for a given general type of feedstock material or blend thereof. It should be noted, however, that the fact that the feedstock is within the predetermined range of 95 to 130 does not guarantee that the product coke will have a CTE value of less than $5.0 \times 10^{-7}$ per ° C. The CTE value of the product coke is also a function of the coking conditions, and in some cases, a particular feedstock, even though it has a preferred BMCI value, may not produce a premium grade coke no matter what the coking conditions are. However, even in this case, the CTE value will be at a minimum for the particular feedstock if the BMCI is in the desired range. Stated another way, some feedstocks, even though they have the desired BMCI, do not produce premium coke. However, the adjustment of BMCI to the desired range optimizes chances for obtaining premium coke, and is a better means of quality control than anything presently available in the art. Feedstocks which are incapable of producing premium coke are generally those that are high in asphaltenes. Optimally, a feedstock for premium coke will be low in asphaltenes and have a BMCI of 95 to 130.

EXAMPLE 3

This example illustrates a situation where a particular feedstock is not capable of producing a premium coke. By operating according to the invention, however, the lowest CTE value obtainable results from operating with a feedstock which has been adjusted to the preferred range as the BMCI value. Blends of vacuum residual oil with varying proportions of a topped tar cut back with premium coker gas oil were utilized in this example. Residual oil is notoriously poor as a feedstock for producing a high quality coke. Even after blending with the aromatic pyrolysis tar, the feedstock would not produce a premium grade coke. However, the blends that were within the preferred BMCI range produced a lower CTE value for the product coke than did the feedstocks which were outside the preferred range as to BMCI value. The feedstock properties in this example are set forth in the following Table VIII.

TABLE VIII

COKER FEEDSTOCK PROPERTIES

| Coker Run No. | 6.17 | 619 | 620 | 618 |
|---|---|---|---|---|
| Feestock Description | | | | |
| Residual Oil, wt % | 100 | 50 | 30 | — |
| Topped Tar, wt % | — | 50 | 70 | 100 |
| API Gravity | 15.6 | 5.5 | −0.4 | −7.9 |
| Specific Gravity | 0.9619 | 1.0327 | 1.0793 | 1.1448 |
| ASTM Distillation, ° F | D-1160 | D-1160 | D-1160 | D-1160 |
| 5, Vol % | 436 | 640 | 621 | 600 |
| 10 | 486 | 656 | 646 | 623 |
| 20 | 554 | 724 | 705 | 657 |
| 30 | 606 | 831 | 780 | 696 |
| 40 | 645 | 909 | 870 | 762 |
| 50 | — | 971 | 949 | 845 |
| 60 | — | — | 1,004 | 916 |
| 70 | — | — | — | — |
| 80 | — | — | — | — |
| 90 | — | — | — | — |
| 95 | — | — | — | — |
| EP | 654 | 1,015 | 1.038 | 954 |
| Recovery, % | 42 | 58 | 68 | 68 |
| Conradson Carbon Residue, wt % | — | 11.8 | — | 25.94 |
| Sulfur, total, wt % | — | 0.62 | — | 0.47 |
| BMCI | 57 | 94 | 117 | 153 |

The resulting product yields and coke quality are shown in Table IX below.

TABLE IX

PRODUCT YIELDS AND COKE QUALITY DATA

| Coker Run No. | 617 | 619 | 620 | 618 |
|---|---|---|---|---|
| BMCI | | | | |
| Fresh Feed | 57 | 94 | 117 | 153 |
| Furnace Charge | — | 105 | 122 | 144 |
| Product Yields | | | | |
| $H_2$ | 0.16 | 0.10 | 1.15 | 0.10 |
| $H_2S$ | — | 0.10 | 0.07 | 0.04 |
| $C_1$ to $C_3$ | 10.0 | 7.9 | 6.0 | 4.7 |
| $C_4$ to 400° F | | | | |
| 400 to 650° F | 60.9 | 55.5 | 48.3 | 41.8 |
| 650° F+ | | | | |
| Coke | 28.9 | 36.4 | 45.5 | 53.4 |
| Coke Quality | | | | |
| Green Coke | | | | |
| Volatile Matter, wt % | 6.9 | 6.7 | 6.9 | 6.4 |
| Sulfur, wt % | 1.37 | — | — | — |
| Calcined Coke | | | | |
| Kerosene Density, g/cc | 2.10 | 2.12 | 2.11 | 2.11 |
| Graphitized Electrode | | | | |
| CTE, $10^{-7}$/° C | 16.9 | 8.5 | 7.4 | 8.1 |

The reason for the correlation between the BMCI value of the feedstock and the CTE value of the product coke cannot be stated with certainty. However, the correlation has been shown to exist, and is an extremely useful tool in carrying out a coking operation to produce premium grade coke having a minimum CTE value. In some cases, the only change from the conventional coking operation would be in checking the BMCI of the feedstock prior to feeding it to the coker. For example, if the BMCI value of the feedstock is within the preferred range of 95 to 130, the feedstock can be passed directly to the coking operation without any adjustment thereof and an optimum product quality can be expected. In the more likely event that the BMCI value of a particular feedstock is not within the preferred range, the feedstock BMCI value can be adjusted, such as by thermal cracking to raise the value, or by blending to lower the value, or by other processing step or steps, such as distillation, adjustment of the coker fractionator conditions, etc.

The specific coking conditions and processing steps to which the invention is applicable may be broadly described as those which are commonly used to produce a premium grade coke. Such conditions and steps are well known in the art and do not form a part of the present invention. A comprehensive discussion thereof appears in the Hackley U.S. Pat. No. 2,922,755 previously mentioned. The present invention provides a simple and reliable method of determining whether a feedstock has optimum potential for producing premium coke, and provides an indication of what adjustments are needed in order to optimize the feedstock.

I claim:

1. In a delayed coking process for producing premium coke wherein a petroleum derived feedstock is charged to a coker furnace, heated to coking temperature, charged to a coking drum and maintained therein at coking conditions until premium coke is formed, the improvement wherein:

a. said feedstock has a BMCI value outside the range of 95 to 130;

b. a desired BMCI value for the feedstock within the range of 95 to 130 is preselected;

c. the BMCI of the feedstock is determined prior to charging same to the coker furnace; and d. the BMCI of the feedstock, prior to charging same to the coker furnace, is adjusted to said preselected desired value.

2. In a delayed coking process for producing premium coke wherein a petroleum derived feedstock is charged to a coker furnace, heated to coking temperature, charged to a coking drum and maintained therein at coking conditions until premium coke is formed, the improvement wherein:

a. a desired BMCI value for said feedstock is preselected within the range of 95 to 130;

b. the actual BMCI value for said feedstock is determined to be different from said preselected value; and c. the BMCI value of said feedstock, prior to charging same to the coker furnace, is adjusted to said preselected desired value.

3. The process of claim 2 wherein said feedstock, prior to adjustment thereof, has a BMCI value outside the range of 95 to 130.

4. The process of claim 2 wherein the adjusting of the BMCI of the feedstock is by blending.

5. The process of claim 2 wherein the adjusting of the BMCI of the feedstock is by thermal cracking the feedstock.

6. The process of claim 2 wherein the BMCI of the adjusted feedstock is determined prior to charging same to the coker furnace.

* * * * *